US005971343A

United States Patent [19]

Marlak

[11] Patent Number: 5,971,343

[45] Date of Patent: Oct. 26, 1999

[54] IN-BED BOOK STAND

[76] Inventor: George Marlak, 8 Maria Hotchkiss Rd., Prospect, Conn. 06712

[21] Appl. No.: 09/148,214

[22] Filed: Sep. 4, 1998

[51] Int. Cl.[6] ..... A47B 19/00; A47B 23/00; A47B 23/04; A47G 1/24

[52] U.S. Cl. ..... 248/441.1; 248/445; 248/447.1; 248/454

[58] Field of Search ..... 248/441.1, 445, 248/446, 447.1, 447.2, 454, 455, 457, 460

[56] References Cited

U.S. PATENT DOCUMENTS

| | | | |
|---|---|---|---|
| 1,531,540 | 3/1925 | Calero | 248/460 |
| 1,598,569 | 8/1926 | Fitzhugh | 248/447.2 |
| 1,609,180 | 11/1926 | Motono | 248/441.1 |
| 1,671,231 | 5/1928 | Culbertson | 248/441.1 |
| 1,899,404 | 2/1933 | White | 248/457 |
| 1,938,638 | 12/1933 | Ponton et al. | 248/457 |
| 2,337,675 | 12/1943 | McNeil | 248/441.1 |
| 2,448,734 | 9/1948 | Phillips | 248/441.1 |
| 2,546,283 | 3/1951 | Webster | 248/441.1 |
| 2,579,740 | 12/1951 | Hiemenz | 248/455 |
| 2,612,721 | 10/1952 | Pollard | 248/441.1 |
| 2,741,869 | 4/1956 | Aibel | 248/441.1 |
| 2,774,177 | 12/1956 | Murgia | 248/457 |
| 2,828,577 | 4/1958 | Anderson | 248/441.1 |
| 2,908,465 | 10/1959 | Lykes | 248/441.1 |
| 3,128,573 | 4/1964 | Johnson et al. | 248/441.1 |
| 3,147,948 | 9/1964 | Evanoff | 248/455 |
| 3,408,032 | 10/1968 | Francis | 248/450 |
| 3,476,348 | 11/1969 | Rustad | 248/445 |
| 3,664,629 | 5/1972 | Reed | 248/454 |
| 3,740,015 | 6/1973 | Adams | 248/454 |
| 3,894,709 | 7/1975 | Weir | 248/445 |
| 4,119,289 | 10/1978 | Kanocz | 248/454 |
| 4,163,539 | 8/1979 | Awofolu | 248/457 |
| 4,313,589 | 2/1982 | Vega | 248/558 |
| 4,431,156 | 2/1984 | Mena | 248/447.1 |
| 4,684,091 | 8/1987 | Moreschi | 248/460 |
| 4,718,630 | 1/1988 | Richard | 248/454 |
| 4,726,556 | 2/1988 | Weir | 248/454 |
| 5,037,056 | 8/1991 | Thompson | 248/441.1 |
| 5,058,848 | 10/1991 | Ferraro | 248/441.1 |
| 5,129,616 | 7/1992 | Carson | 248/446 |
| 5,199,680 | 4/1993 | Rivera | 248/454 |

FOREIGN PATENT DOCUMENTS

| | | | |
|---|---|---|---|
| 1135157 | 11/1955 | France | 248/457 |
| 514252 | 12/1930 | Germany | 248/447.2 |
| 553554 | 6/1932 | Germany | 248/447.1 |
| 3483 | 5/1919 | Netherlands | 248/445 |

*Primary Examiner*—Derek J. Berger
*Assistant Examiner*—Michael D. Nornberg
*Attorney, Agent, or Firm*—Hovey, Williams, Timmons & Collins

[57] ABSTRACT

A book stand (10) including a book rack (24) configured for coupling with a pair of support members (12,14) in a spanning relationship. The support members (12,14) are coupled with a pair of bases (16,18) for engaging the support surface. The book rack (24) includes front panels (46,48) and a back panel (44) being configured to receive front and back covers **(54*a*,54*b*) of book (56) respectively therebetween with the pages (58) thereof extending through gap (50) defined by the spacing of the front panels (46,48). This allows a supine user to read while the book stand (10) supports the weight of book (56)**.

14 Claims, 3 Drawing Sheets

IN-BED BOOK STAND

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

This invention relates to the field of book support racks. More particularly, the invention is concerned with a book stand that supports a book over a supine user.

2. Description of the Prior Art

While reading in bed, it is difficult to hold a book without some way to support the weight and properly position the book at a comfortable position for reading. Book stands have been developed to support the weight of a book to make it easier to read in bed, but these devices can be expensive, heavy and may be not adjustable.

SUMMARY OF THE INVENTION

The present invention solves the problems mentioned above and provides a distinct advance in the state of the art. In particular, the book stand hereof is economical, lightweight and adjustable.

The preferred book stand includes a pair of support members attached to a respective pair of bases configured to engage a bed or other support surface. The support members are attached to the bases by a set of couplers, each coupler set being configured to position the support members at a predetermined angle relative to the support surface. A book rack is attached to the support members in a spanning relationship therewith.

In preferred forms, the support members, bases and coupler sets are synthetic resin pipe components. Each coupler set includes a pair of synthetic resin pipe couplers. The preferred book rack is also integrally formed of synthetic resin material, and includes a back panel, two front panels connected by a bottom that is U-shaped in transverse cross-section. The back panel and two front panels are spaced to receive a the covers of a book with the book pages extending through the gap between the front panels. The bottom is configured to support a portion of the weight of the book.

DETAILED DESCRIPTION OF THE PREFERRED EMBODIMENTS

Figure 1:
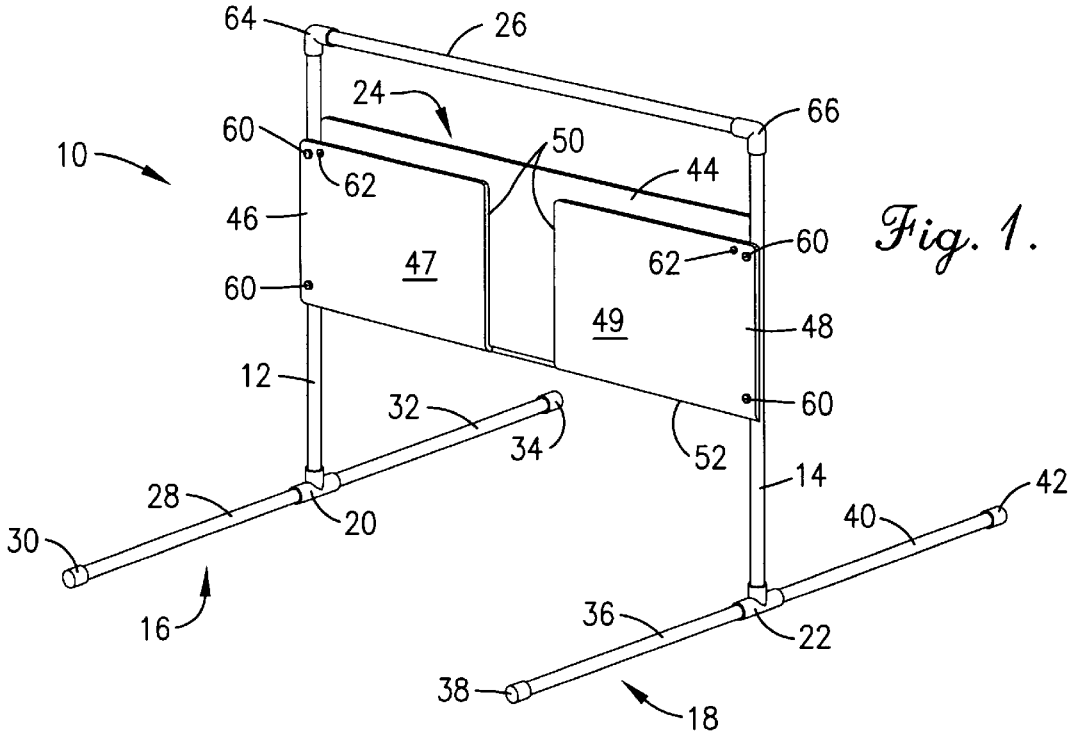
FIG. 1 is a pictorial view of the preferred book stand in accordance with the present invention.

The drawing figures illustrate preferred book stand 10 in accordance with the present invention. Referring initially to FIGS. 1–5, book stand 10 includes left support member 12, right support member 14, left support base 16, right support base 18, left coupler 20, right coupler 22, book rack 24 and handle 26. In the preferred embodiment, support members 12,14, support bases 16,18, couplers 20,22 and handle 26 are composed of synthetic resin (PVC) pipe components, preferably ½" PVC schedule 40. PVC components are preferred for low cost, light weight and easy assembly.

As shown in FIGS. 1–5, left support base 16 includes left front foot 28 with the distal end enclosed by end cap 30, and left rear foot 32 with the distal end enclosed by end cap 34. Left coupler 20, in the nature of a pipe tee, couples the inboard ends of feet 28 and 32. Right support base 18 includes right front foot 36 with the distal end enclosed by end cap 38, and right rear foot 40 with the distal end enclosed by end cap 42. Right coupler 22, also in the nature of a pipe tee, couples the inboard ends of feet 36 and 40.

Figure 2:
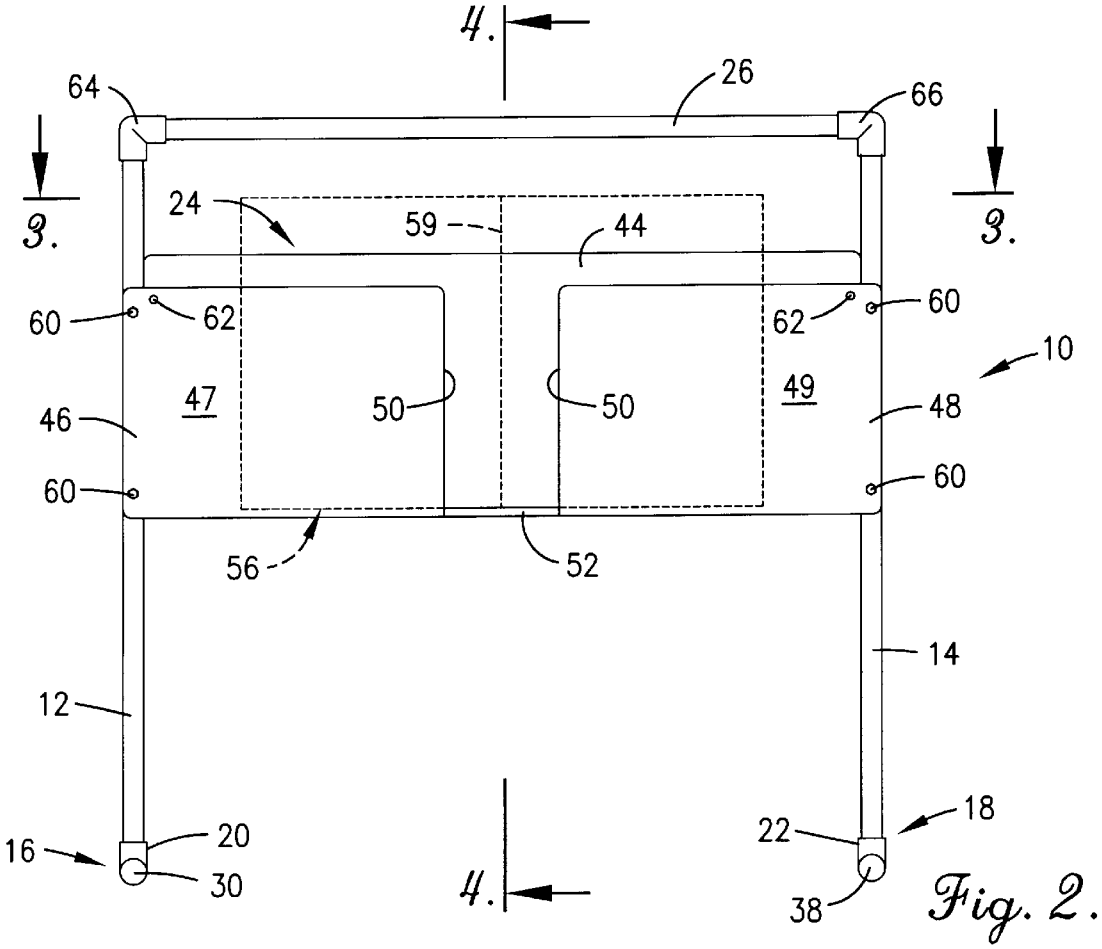
FIG. 2 is a front, elevational view of the book stand of FIG. 1 with a book shown therewith in phantom lines.
Figure 3:
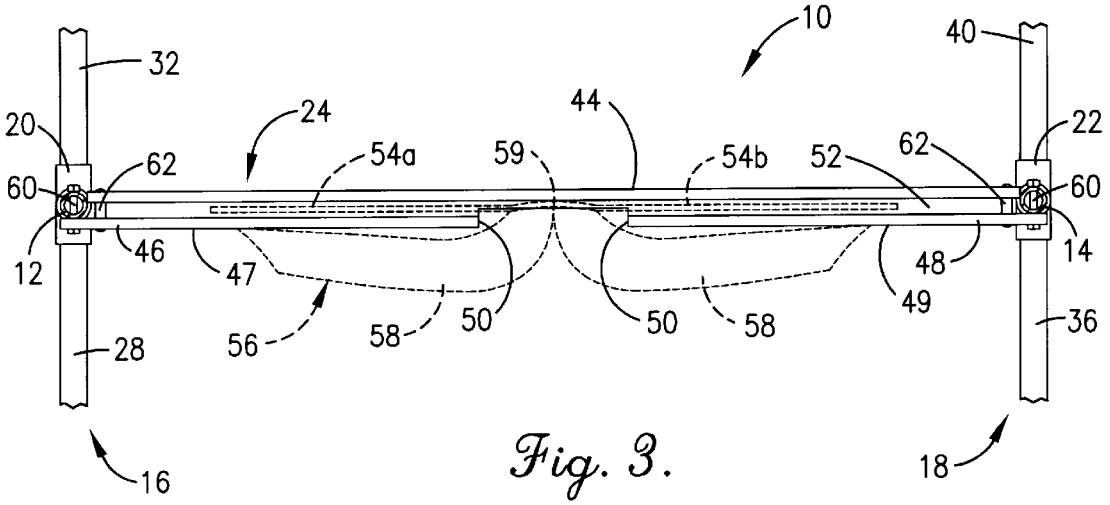
FIG. 3 is a sectional view taken along line 3—3 of FIG. 2, showing a book supported therein in phantom lines.
Figure 4:
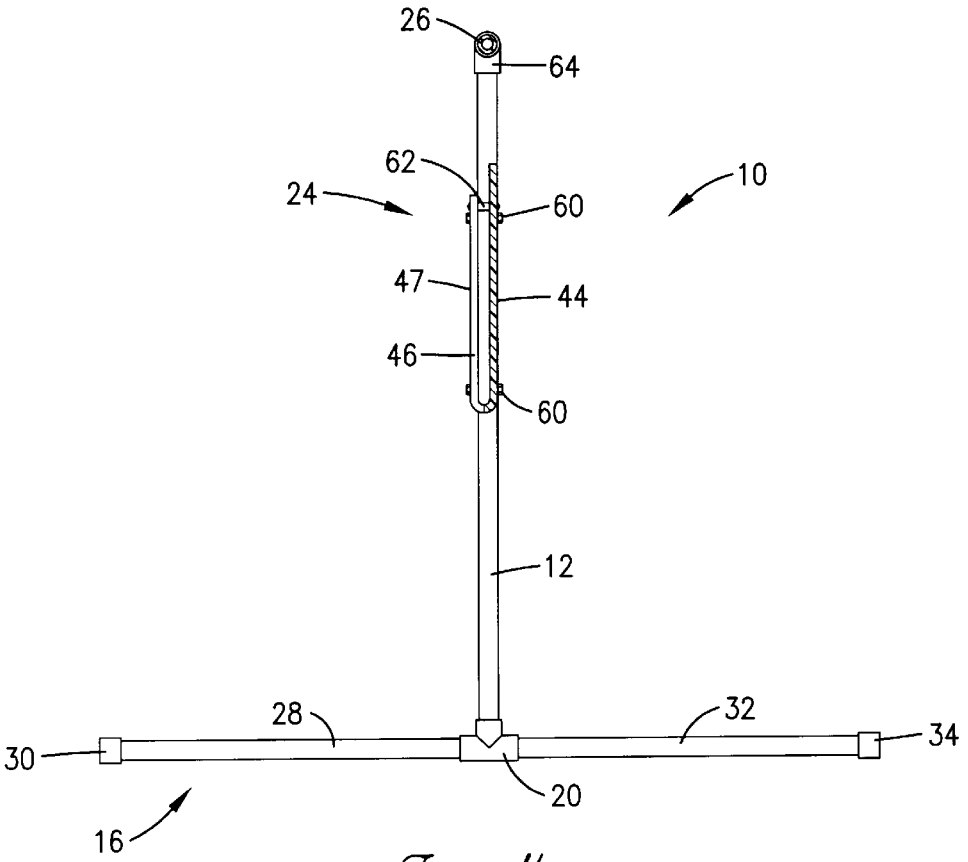
FIG. 4 is a sectional view taken along line 4—4 of FIG. 2.

Book rack 24, as illustrated in FIGS. 1–4, is preferably formed of synthetic resin material and includes back panel 44, left front panel 46 and right front panel 48. Front panels 46,48 are spaced from back panel 44 and generally parallel thereto, and spaced side-to-side from one another to define a gap 50. As shown in FIG. 3, bottom 52 interconnects back panel 44 and front panels 46,48 at the lower margins thereof. Fasteners 60, in the nature of nuts and bolts, removably attach book rack 24 to support members 12,14. Rivets 62 secure back panel 44 to front panels 46,48.

FIGS. 1–2 illustrate the preferred handle 26 of book stand 10. Elbow joints 64 and 66 connect handle 26 between the distal ends of support members 12,14.

Couplers 20,22 removably receive the respective lower ends of support members 12,14. In the embodiment of FIGS. 1–5, couplers 20,22 position support members 12,14 generally transverse to bases 16,18 and thus presents the book rack 24 in an upright position, directly in front of a supine user.

Figure 5:
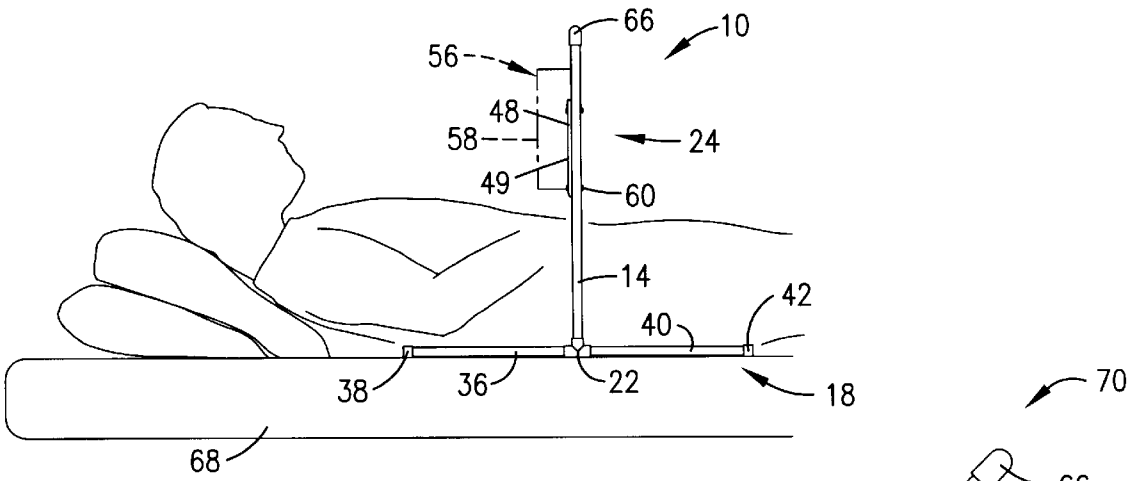
FIG. 5 is a side, elevational view of the book stand of FIG. 1, shown in use on a bed using the upright coupler set, to support a book shown in phantom lines.

FIG. 5 illustrates book stand 10 in use with support bases 16,18 resting on bed 68 (base 16 not shown) with book 56 held in book rack 24. In particular, front book cover 54*a* is positioned behind left front panel 46, back book cover 54*b* is positioned behind right front panel 48 and pages 58 extend through gap 50, supported by outer faces 47,49 of respective front panels 46,48. Bottom 52 supports the lower end of spine 59 of book 56.

The preferred embodiment of book stand 10 allows a supine person to read without having to support book 56. Book 56 may be positioned at an easy arm's reach and distance for reading.

Because the invention is lightweight, any user able to lift the weight of a book 56 can move it on or off any support surface. The simple construction from PVC pipe, pipe couplers, nuts and bolts allows a user to assemble or disassemble book stand 10 without tools. Book stand 10, in its disassembled form can be stored easily under bed 68 or in any convenient location. This also allows book stand 10 to be easily packaged and shipped.

Figure 7:
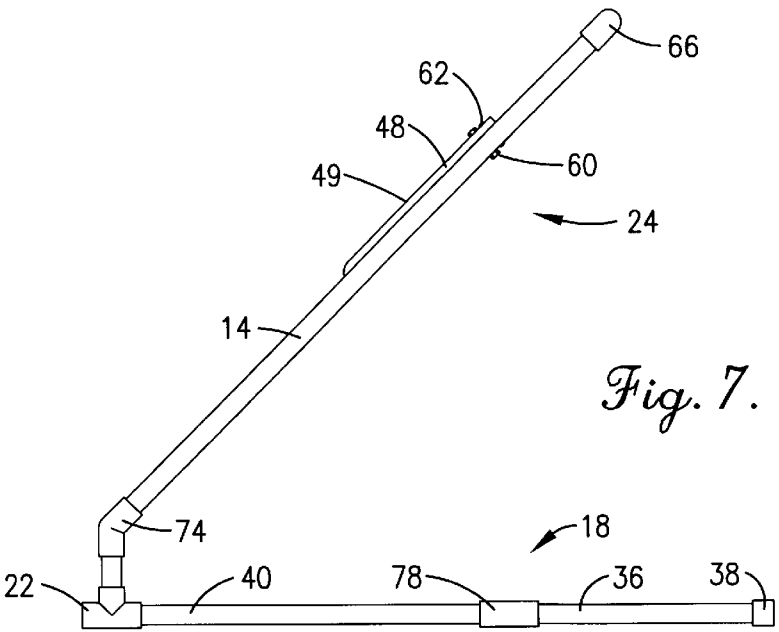
FIG. 7 is a side, elevational view of the book stand of FIG. 6.
Figure 6:
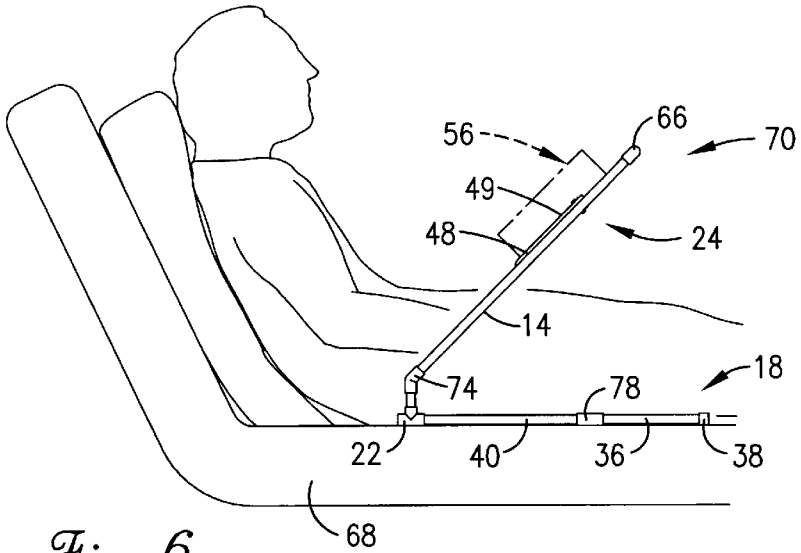
FIG. 6 is a side, elevational view similar to FIG. 5, but using the 45° coupler set.

FIGS. 6–7 illustrate book stand 70 as a second embodiment of the present invention. Book stand 70 is similar to book stand 10 and common components bear the same numerical designation. In particular, book stand 70 includes left 45° coupler extension 72, right 45° coupler extension 74, left in-line coupler 76 and right in-line coupler 78.

Left support member 12 is removably coupled with left 45° coupler extension 72, which in turn is coupled with left coupler 20. Right support member is removably coupled with right 45° coupler extension 74, which is also coupled with right coupler 22.

As shown in FIGS. 6–7, left support base (not shown) includes left rear foot (not shown) coupled with left front foot (not shown) by left in-line coupler (not shown). End cap 30 encloses the distal end of left front foot (not shown). Left coupler (not shown), in the nature of a pipe tee, couples the inboard ends of left rear foot (not shown). Right support base 18 includes right rear foot 40 coupled with right front foot 36 by right in-line coupler 78. 38 encloses the distal end of right front foot 36 and right coupler 22, in the nature of a pipe tee, couples the inboard ends of right rear foot 40.

Book stand 70 presents book 56 at a 45° angle, allowing the user to read comfortably in a more upright posture. This embodiment can be used in conjunction with an adjustable bed 68 as shown in FIG. 6. It may also be used on the floor if the user desires to lean up against a couch or other object.

It is preferred the present invention be sold in a kit with a plurality of coupler sets. Such could include the 90° and 45° coupler, but other angles or coupler types such as 60° and 75° could be included.

Those skilled in the art will appreciate that the present invention encompasses many variations in the preferred embodiments described herein. For example, the coupler sets could contain many different angles besides those mentioned above. Also the couplers could be adjustable, allowing the user to modify the presentation angle of book rack 24 without changing coupler sets. The preferred embodiment is made of ½" PVC schedule 40, but the type of PVC used could be varied. Book stand 10 could also be made of other materials such as wood or metal such as aluminum. The bases 16,18, handle 26 and support members 12,14 could be made from wire or rods instead of pipes. Book rack 24 could be a basic construction such as made from wire or rods and it would not have to be integrally formed.

Having thus described the preferred embodiments, the following is claimed as new and desired to be secured by Letters Patent:

We claim:

1. A book stand comprising:

a pair of support members;

a pair of detachable bases configured to engage a support surface;

coupling structure to removably couple said support members with said detachable bases respectively; and a detachable book rack configured to removably couple with said support members in a spanning relationship therewith, said coupling structure including a plurality of detachable coupler sets, each set being configured to position said members at a predetermined angle relative to said detachable bases.

2. The book stand of claim 1, said detachable coupler sets including a coupler set configured to position said support members in a generally upright position relative to said detachable bases.

3. The book stand of claim 2, said detachable coupler sets further including a coupler set configured to position said support members at about 45° relative to said detachable bases.

4. The book stand of claim 1, each of said coupler sets including a pair of synthetic resin pipe couplers.

5. The book stand of claim 1, said detachable book rack including a back panel presenting a lower margin, a pair of front panels spaced from said back panel, generally parallel thereto and spaced side-to-side from one another to define a gap therebetween, said front panels presenting respective lower margins, a bottom interconnecting said lower margins of said back and said front panels thereby coupling said back panel and said front panels, each of said front panels and said back panel being positioned for receiving the respective covers of a book therebetween with the pages thereof extending through said gap so that the pages can be easily turned from the front of said book stand and said front panels and said back panel present a clear and unobstructed view and path to said pages.

6. The book stand of claim 5, said bottom being configured to support the lower end of the spine of a book and thereby supporting at least a portion of the weight of the book.

7. The book stand of claim 6, said front panels presenting respective outer faces, said outer faces of said front panels being configured to support the pages of a book.

8. The book stand of claim 7, said detachable book rack is being integrally formed of synthetic resin material.

9. The book stand of claim 8 including a detachable handle configured for coupling with said support members in a spanning relationship therewith, said handle, said support members, and said detachable bases being formed from synthetic pipe, said detachable coupler sets including a coupler set configured to position said support members in a generally upright position relative to the support surface.

10. The book stand of claim 1 further including a detachable handle configured to couple with said support members in a spanning relationship therewith.

11. The book stand of claim 10, said support members, said detachable bases and said detachable handle being formed from synthetic resin pipe.

12. A book stand comprising:

a pair of support members;

a pair of detachable bases configured to engage a support surface;

coupling structure to removably couple said support members with said detachable bases respectively, said coupling structure including detachable coupler sets including a coupler set configured to position said support members in a generally upright position and a coupler set configured to position said support members at about 45° relative to said detachable bases; and a detachable book rack configured to couple with said support members in a spanning relationship therewith, said detachable book rack including, a back presenting a lower margin, a front including a pair of front panels spaced from said back, generally parallel thereto and spaced side to side from on another to define a gap therebetween, said front panels presenting respective lower margins, and a bottom interconnecting said lower margins thereby coupling said back and said front panels, each of said front panels and back panel being positioned for receiving the respective covers of a book therebetween with the pages thereof extending through said gap so that the pages can be easily turned from the front of said book stand and said front panels and said back panel present a clear and unobstructed view and path to said pages.

13. The book stand of claim 12, each of said detachable coupler sets including a pair of synthetic resin pipe couplers.

14. A book stand comprising:

a pair of spaced support members;

a pair of detachable bases configured to engage a support surface;

coupling structure to removably couple said support members with said detachable bases respectively, said coupling structure includes a plurality of detachable coupler sets, each set being configured to position said members at a predetermined angle relative to said detachable bases; and a detachable book rack configured to couple with said support members in a spanning relationship therewith, said detachable book rack including a back panel presenting a lower margin, a pair of front panels spaced from said back panel, generally parallel thereto and spaced side-to-side from one another to define a gap therebetween;

said front panels presenting respective lower margins, a bottom interconnecting said lower margins of said back panel and said front panels thereby coupling said back panel and said front panels, and each of said front panels and back panel being positioned for receiving the respective covers of a book therebetween with the pages thereof extending through said gap so that the pages can be easily turned from the front of said book stand and said front panels and said back panel present a clear and unobstructed view and path to said pages, said support members and said detachable bases being formed from synthetic resin pipe.

* * * * *